US010297410B2

(12) United States Patent
Hosomizo et al.

(10) Patent No.: US 10,297,410 B2
(45) Date of Patent: May 21, 2019

(54) FUSE ELEMENT

(71) Applicant: Pacific Engineering Corporation, Ogaki-Shi, Gifu (JP)

(72) Inventors: Hiroyoshi Hosomizo, Ogaki (JP); Mitsuru Ando, Ogaki (JP)

(73) Assignee: Pacific Engineering Corporation, Ogaki-Shi, Gifu (JP)

( * ) Notice: Subject to any disclaimer, the term of this patent is extended or adjusted under 35 U.S.C. 154(b) by 399 days.

(21) Appl. No.: 14/764,345

(22) PCT Filed: Jan. 29, 2014

(86) PCT No.: PCT/JP2014/000435

§ 371 (c)(1),
(2) Date: Jul. 29, 2015

(87) PCT Pub. No.: WO2014/122898

PCT Pub. Date: Aug. 14, 2014

(65) Prior Publication Data

US 2015/0371803 A1 Dec. 24, 2015

(30) Foreign Application Priority Data

Feb. 5, 2013 (JP) ..... 2013-020353

(51) Int. Cl.
*H01H 85/143* (2006.01)
*H01H 85/10* (2006.01)
(Continued)

(52) U.S. Cl.
CPC ..... *H01H 85/143* (2013.01); *H01H 85/10* (2013.01); *H01H 85/12* (2013.01); *H01H 69/02* (2013.01); *H01H 85/153* (2013.01)

(58) Field of Classification Search
CPC ..... H01H 85/08; H01H 85/10; H01H 85/12; H01H 85/143; H01H 69/02; H01H 85/153
(Continued)

(56) References Cited

U.S. PATENT DOCUMENTS 1,290,860 A 1/1919 Bender
3,189,712 A * 6/1965 Kozacka ..... H01H 85/0456 337/158
(Continued)

FOREIGN PATENT DOCUMENTS

DE 2802050 A1 7/1979
JP 57126040 A 8/1982
(Continued)

OTHER PUBLICATIONS

English translation and native language of International Search Report of corresponding International Application No. PCT/JP2014/000435 (WO 2014/122898 A1 published Aug. 14, 2014); dated Apr. 28, 2014; 6 pages.

*Primary Examiner* — Jacob R Crum
(74) *Attorney, Agent, or Firm* — Shumaker, Loop & Kendrick, LLP

(57) ABSTRACT

A fuse element including a pair of terminal sections positioned at opposite ends of the fuse element, a plurality of spaced parallel rows of elements connecting the terminal sections, and a plurality of fused sections formed in substantially central sections of the elements, wherein the terminal sections and the elements or the elements alone are formed by stamping a single metal plate to separate a piece having a predetermined shape therefrom and bending the piece into a predetermined three-dimensional shape.

6 Claims, 18 Drawing Sheets

(51) Int. Cl.
*H01H 85/12* (2006.01)
*H01H 69/02* (2006.01)
*H01H 85/153* (2006.01)

(58) Field of Classification Search
USPC ..... 337/293, 295, 416
See application file for complete search history.

(56) References Cited

U.S. PATENT DOCUMENTS 3,261,952 A * 7/1966 Kozacka ..... H01H 85/10
337/159
3,291,943 A * 12/1966 Kozacka ..... H01H 85/10
337/163
3,935,553 A * 1/1976 Kozacka ..... H01H 85/0456
337/159
5,905,426 A * 5/1999 Douglass ..... H01H 85/10
337/228
6,194,989 B1 2/2001 Douglass
2013/0009744 A1* 1/2013 Douglass ..... H01H 85/0013
337/187

FOREIGN PATENT DOCUMENTS

JP 2007-059082 A 3/2007
JP 2012-043573 A 3/2012

* cited by examiner

FUSE ELEMENT

TECHNICAL FIELD

The present invention relates to a fuse element for use in protecting various electric circuits in, for example, automobiles and, more specifically to a fuse element in which a plurality of parallel rows of fused sections are arranged between a pair of terminal sections.

BACKGROUND ART

A fuse element is a protection element that interrupts an electric circuit promptly when an unexpected high current flows through it. Different types of fuse elements are now available.

One example of such fuse elements is a fuse element 51 built in an in-vehicle fuse 50 illustrated in FIG. 10 (e.g., other similar examples are described in Patent Documents 1 and 2).

The in-vehicle fuse 50 includes: a cylindrical casing 52; a fuse element 51 contained in the cylindrical casing 52; and arc-extinguishing sand 53 filled between the fuse element 51 and the cylindrical casing 52.

The fuse element 51 is positioned at the center of the casing 52 and has terminal sections 54 protruding from both ends of the cylindrical casing 52. To increase its rated current, the terminal sections 54 and 54 are integrally connected to four elements 55 . . . 55, which are arranged in parallel at preset regular spacings.

Many methods are employed to fabricate the fuse element 51 configured above. One typical fabricating method will be described with reference to FIG. 11. First, a pair of terminal sections 54 and four long, narrow elements 55 are individually prepared. Specifically, each terminal section 54 has notched grooves 54*a* that form a cross shape; each element 55 has a plurality of small holes 56 created with stamping such that small, narrow fused sections 57 are left therebetween. Then, both ends 55*a* and 55*a* of each element 55 are bent and latch onto the corresponding notched grooves 54*a* of the terminal sections 54. After that, each element 55 is fixed to both the terminal sections 54 at these latching sites by means of, for example, soldering or brazing.

Disadvantages with the method of fabricating the fuse element 51 described above are as follows. Before soldered to the elements 55, the terminal sections 54 need to be subjected to many processes, including at least blank layout, cutting, bending, and the cutting and raising of the notched parts 54*a*. Likewise, each element 55 needs to be subjected to many fabricating processes, including at least blank layout, cutting, the forming of the fused sections 57 (the stamping step for the small holes 56), and the bending of both ends 55*a*.

Furthermore, the process of soldering each element 55 to both the terminal sections 54 requires complex positioning steps using a jig (not illustrated), such as a step of adjusting the spacings between the elements 55 and the parallelism thereof, which may involve a lot of experience and skill.

In the method of fabricating the existing in-vehicle fuse 51 with the plurality of elements 55, as described above, a process of fabricating and assembling components of the fuse element 51 may involve a high degree of skill and a lot of time, resulting in low productivity and high overall costs of the entire in-vehicle fuse 50.

Patent Document 1: U.S. Pat. No. 4,101,860 (parts indicated by the reference signs 82 and 84 in FIG. 8)

Patent Document 2: U.S. Pat. No. 5,055,817 (parts indicated by the reference signs 30 and 32 in FIG. 2)

SUMMARY OF THE INVENTION

A first object of the present invention, which addresses disadvantages, as described above, of existing in-vehicle fuses, is to provide a fuse element in which a plurality of elements that have fused sections in their substantially central sections connect a pair of terminal sections and which allows for a big improvement in processing, exhibiting greatly superior productivity at an extremely low cost.

A second object is to provide a fuse element in which, when a normal current flows through it, its casing resists cracking and damage, such as burnout, that would be caused due to heat from the element.

A fuse element according to the present invention, which accomplishes the above first object, includes: a pair of terminal sections positioned at both ends of the fuse element; a plurality of parallel rows of elements arranged at a predetermined spacing, the elements connecting the terminal sections; and a plurality of fused sections formed in substantially central sections of the elements. All of the terminal sections positioned at both ends and the plurality of elements or the plurality of elements alone are formed by stamping a single metal plate to separate a piece having a preset shape therefrom and bending the piece into a predetermined three-dimensional shape (this invention is referred to below as a "first invention").

The expression "a plurality of parallel rows of elements arranged . . . the terminal sections" in the first invention introduces a wide variety of concepts, including a concept that "the terminal sections are arranged in parallel."

The expression "a fuse element . . . formed by stamping a single metal plate to separate a piece having a preset shape therefrom and bending the piece into a predetermined three-dimensional shape" does not necessarily represent a fuse element obtained only from a stamping process and a bending process. It should be understood that this expression implies other processes required to fabricate the fuse element, including a striking and flattening process for a thickness adjustment and a spreading process that are to be performed before the above two processes and an inspection process to be performed after those processes.

The expression "a fuse element . . . bending the piece into a predetermined three-dimensional shape" represents a fuse element bent into a final three-dimensional shape through the above processes. More specifically, the expression represents a fuse element bent into a three-dimensional, compact shape so that it can be contained easily within a cylindrical casing. Examples of this three-dimensional shape include, but are not limited to, any given shapes, such as a substantially inverted "S" shape, a substantially "Z" shape, a square shape, and a circular shape of the lateral cross-section of the fused section, which correspond to embodiments 1 to 4, respectively, that will be described later.

The "terminal sections" do not have any limited shape and type; their examples include various types of terminal sections, including blade-shaped terminal sections and box-shaped terminal sections (insertion types of terminal sections) structured to cover a connection terminal.

The "elements" recited in this invention are conductive metal parts that connect the terminal sections positioned at both ends, and each have a fused section in its substantially central section which interrupts an electric circuit promptly when an unexpected high current flows through it.

The "fused sections" in the present invention represent the substantially central sections of the elements. The fused sections of the present invention do not have any specific or limited shape or type. For example, each fused section may have a portion having a smaller cross-section, and an area over or near this portion may be subjected to deposition using a metal having a low melting point, such as tin, silver, lead, nickel, or an alloy thereof.

A material for the above "terminal sections" and "elements" may be any conductive metal. However, the terminal sections and elements in the present invention, which are formed by stamping a single metal plate to separate a piece having a preset shape and bending the piece into a three-dimensional shape requested for the fuse element as described above, are preferably made of copper or a copper alloy exhibiting good conductivity and bending and spreading performances.

The terminal sections and elements of the present invention do not necessarily have to be integrally made of the same metal (base material). At least the above "elements" only have to be formed by stamping a single metal plate to separate a piece having a preset shape and bending the piece into a predetermined three-dimensional shape.

Then, the elements may be integrally connected to the terminal sections that are separate units fabricated in advance with, for example, fastening hardware including screws, bolts and nuts or by means of soldering, brazing or welding.

The "preset shape" in the expression "stamping a single metal plate to separate a piece having a preset shape therefrom" represents "the developed shape" of a base material for the fuse element which has not been subjected to the bending process. Specifically, this shape depends on, for example, an application of a fuse, a fuse element type, and a desired rated current. To obtain a piece formed into the developed shape of the fuse element, a stamping tool having a cutting blade conforming to this developed shape is preferably used to stamp a single metal plate at only one time in which blanks have been laid out. However, the terminal sections, the elements, and the fused sections may be individually obtained through different processes to the extent that process simplification is not hindered.

The embodiment regarded as being the most preferable from the viewpoint of the technical idea of the present invention is that all of the terminal sections and the plurality of elements are formed by stamping a single metal plate to separate a piece having a preset developed shape and bending the piece in a predetermined three-dimensional shape (this invention referred to below as a "second invention").

As a result of the stamping and bending processes described above, the plurality of elements are arranged in parallel and at a predetermined spacing between the terminal sections. Thus, a fuse element in which a parallel circuit with the fused sections is formed between the terminal sections is obtained (this invention referred to below as a "third invention").

The third invention limits the "parallel rows" of terminal sections arranged in the first invention described above to the terminal sections arranged "in parallel."

The plurality of elements are preferably bent in a direction intersecting a direction of the terminal sections, and all of the elements are preferably bent and shrunk in the direction of the terminal sections (this invention referred to below as a "fourth invention").

A relationship between "bent in a direction intersecting a direction of the terminal sections" in the fourth invention and "bending the piece into a predetermined three-dimensional shape" in the first invention is as follows. Processing a metal plate into the final shape of the first invention involves a plurality of steps, and the bending of the piece in the fourth invention corresponds to a specific one of these steps.

In the bending process, it is only necessary to bend the piece. For example, however, a linear or curved bending line may be formed on the piece and this piece may be bent along this bending line.

A relationship between "all of the elements are bent and shrunk in the direction of the terminal sections" and "bending the piece into a predetermined three-dimensional shape" in the first invention is as follows. The process through which all of the elements are bent and shrunk in the direction of the terminal sections corresponds to a specific one of a plurality of steps required to process the piece into a final shape in the first invention. The reason why all of the elements are bent and shrunk in the direction of the terminal sections is that the elements need to accommodate its thermal expansion in the direction of the terminal sections which would be caused due to a temperature rise when a current flows through them.

When a normal current flows through the elements, the fused sections, which are the smallest in cross-section, generate Joule heat. Then, this Joule heat may be transmitted to a casing during a long period of use, thermally damaging it. When an unexpected high current flows through the fused sections and the fused sections are thereby blown, the arc-extinguishing sand might prevent these fused sections from generating an arc with great thermal energy. Nevertheless, the blowout of the fused sections may cause burnout of the casing or cracking therein.

To avoid the above disadvantage, the fuse element according to the present invention in which the plurality of elements are bent into a predetermined three-dimensional shape is preferably configured such that one of the plurality of elements which is positioned away from a central one of the plurality of elements has a smaller width than the central element (this invention referred to below as a "fifth invention").

All or some of the plurality of elements configuring the fuse element of the fifth invention described above may be bent and shrunk in the direction of the terminal sections, and the element positioned away from the central element has a fused section of a smaller fusing width than the central element. (this invention referred to below as a "sixth invention").

The present first to sixth inventions described above are not only "product inventions" relating to a "fuse element" but also inventions specified by "so-called product-by-process claims" including two fabricating processes, a "stamping processes and a "bending process." In which case, the present invention includes these two processes as essential components.

According to the first invention, a fuse element has a plurality of elements each including a fused section which are formed by stamping a single metal plate to separate a piece having a preset shape therefrom and bending the piece into a predetermined three-dimensional shape. This fuse element eliminates the need to fabricate separately a pair of terminal sections and four elements each including a fused section, unlike an existing fuse element 50 having an element 51 illustrated in FIGS. 10 and 11. Therefore, the terminal sections and elements in this fuse element can be formed simultaneously.

The fuse element of the first invention involves no complicated works, such as that for soldering a plurality of elements to terminal sections while individually adjusting their relative locations accurately.

The fuse element of the first invention therefore allows for very simple fabricating processes (or a small number of processes) and requires no special experience and skill of manufacturers, adapting itself for mass production. Moreover, the fuse element of this invention enables greatly superior productivity of a fuse containing this fuse element.

The fuse element of the first invention provides high quality and significantly high dimensional accuracy, because the pair of terminal sections is originally integrated with the plurality of elements each including the fused section without involving any connection process.

The fuse element of the first invention can reduce arc energy by splitting a fusing current flow into multiple flows, because a parallel circuit with the fused sections is formed between the pair of terminal sections.

According to the second invention, a fuse element, in which terminal sections and a plurality of elements are all formed by stamping a single metal plate to separate a piece having a preset shape therefrom and bending the piece into a predetermined three-dimensional shape, produces an effect of providing superior productivity at a low cost, in addition to the above effects of the first invention.

According to the third invention, a fuse element has a parallel circuit with any number of fused sections which is formed between terminal sections, and can be fabricated easily at a low cost.

According to the fourth invention, a fuse element in which all elements are bent and shrunk in a direction of terminal sections can sufficiently accommodate the thermal expansion of the elements in the direction of the terminal sections which would be caused due to a temperature rise when a current flows through the elements. This provides a fuse element with a good fusing property and a long lifetime.

According to the fifth invention, a fuse element, in which one of the plurality of elements which is positioned away from a central one of the plurality of elements has a smaller width than the central element and the element positioned away from the central element is bent in a direction intersecting a direction of the terminal sections, provides equal distances between a casing inner wall surface and the respective ends of all the elements in their width directions.

The fuse element of the fifth invention produces, in addition to the effects of the first to fourth inventions, an effect of filling arc-extinguishing sand uniformly between the casing inner wall surface and the respective ends of all the elements in their width directions, thus improving the arc-extinguishing performance. This reduces damage to the casing inner wall surface which is caused by Joule heat generated when a normal current flows through fused sections or an arc generated upon blowout of the fused sections.

According to the sixth invention, a fuse element in which all or some of a plurality of elements configuring the fuse element of the fifth invention are bent and shrunk in a direction of terminal sections can sufficiently accommodate the thermal expansion of the elements in the direction of the terminal sections which would be caused due to a temperature rise when a current flows through the elements.

The fuse element of the sixth invention, in which the element positioned away from the central element has a fused section of a smaller fusing width than the central element, provides equal distances between a casing inner wall surface and the respective ends of all the elements in their width directions. This produces the same effect as the fifth invention and further produces an effect of filling arc-extinguishing sand uniformly between a casing inner wall surface and the respective ends of all the elements in their width directions, thus providing a good arc-extinguishing performance.

BRIEF DESCRIPTION OF THE DRAWINGS

FIG. 4(*a*) is a perspective view of the entire fuse element, and FIG. 4(*b*) is an enlarged, lateral cross-sectional view of the fuse element illustrated in FIG. 4(*a*) as seen from the direction of the line V-V.

FIG. 5(*a*) is a perspective view of the entire fuse element, and FIG. 5(*b*) is an enlarged, lateral cross-sectional view of the fuse element illustrated in FIG. 5(*a*) as seen from the direction of the line W-W.

EMBODIMENTS OF THE INVENTION

One embodiment of the present invention will be described below with reference to FIGS. 1 to 9.

Example 1

<Overall Configuration of the Present Invention>

Figure 1:
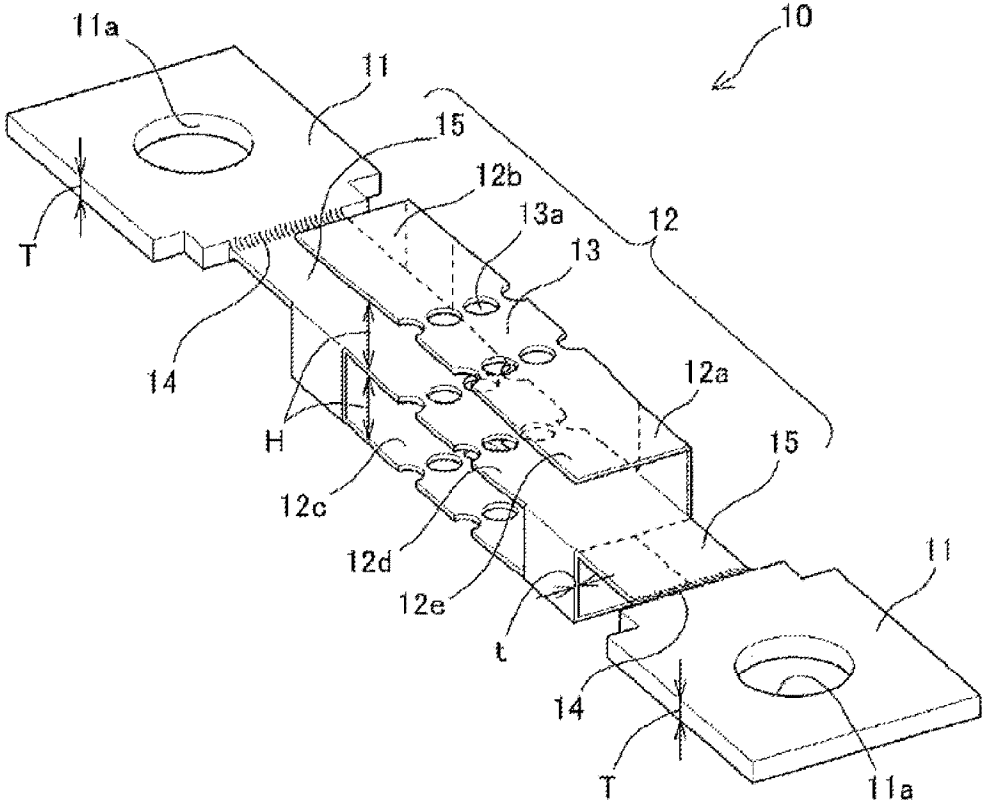
FIG. 1 is a perspective view of an entire fuse element according to a first embodiment of the present invention.

FIG. 1 is a perspective view of an entire fuse element 10 according to one embodiment of the first invention that will be described above.

Referring to FIG. 1, the fuse element 10 in this embodiment includes: a pair of plate-shaped terminal sections 11 and 11 positioned at both ends; an element 12 connecting the pair of terminal sections 11 and 11; and fused sections positioned in a substantially central section 13 of the element 12.

In this embodiment, both the terminal sections 11 and 11 and the element 12 are each made of copper or a copper alloy, which is plastically deformable and has excellent crease and spreading performances, but any given metal may obviously be used.

Figure 10:
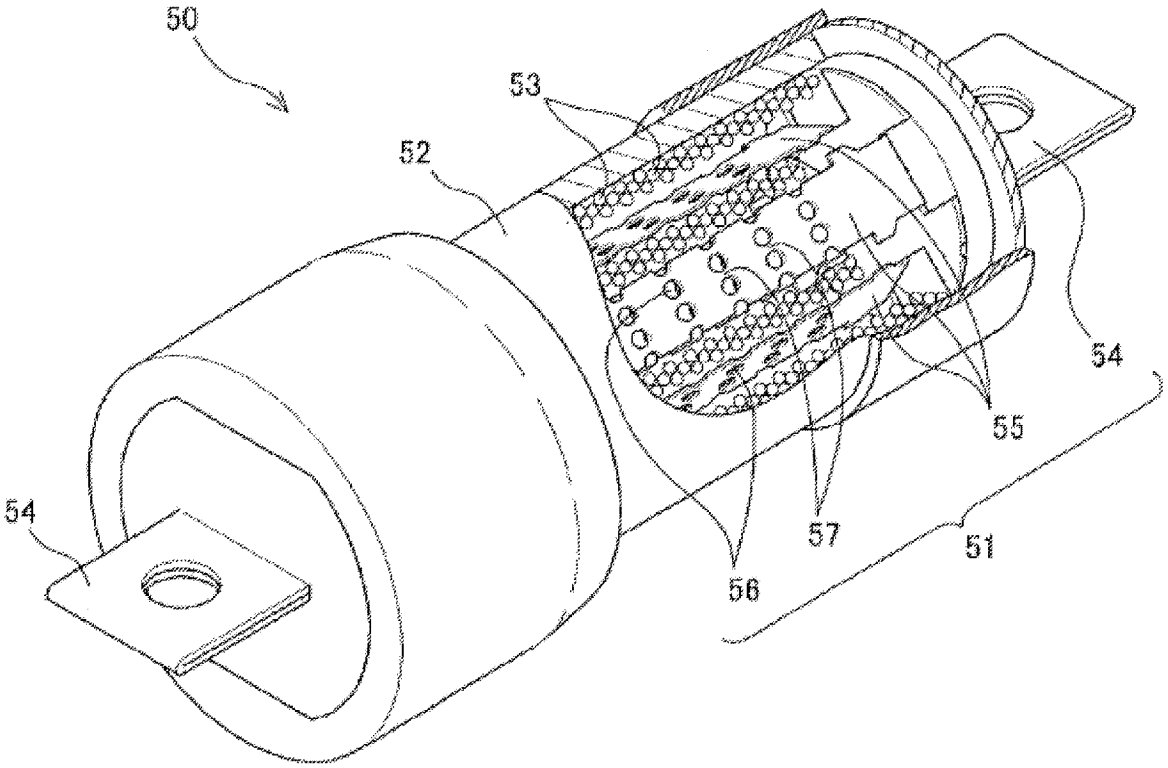
FIG. 10 is a perspective view of an entire existing in-vehicle fuse containing arc-extinguishing sand with its casing partially cut.

Each of the terminal sections 11 and 11 has an attachment hole 11*a* via which the fuse element 10 is to be attached to an electrical apparatus (not illustrated). Each terminal section 11 in this embodiment is formed of a single sheet as illustrated in the drawing, but if each terminal section 54 needs to have a larger thickness like the terminal sections 54 described above in FIG. 10, it may be made by forming two terminal sections into the same outer shape and bending and stacking them. In this case, the development view of the terminal sections 54 is formed, of course, into an unbent shape.

Figure 2A:
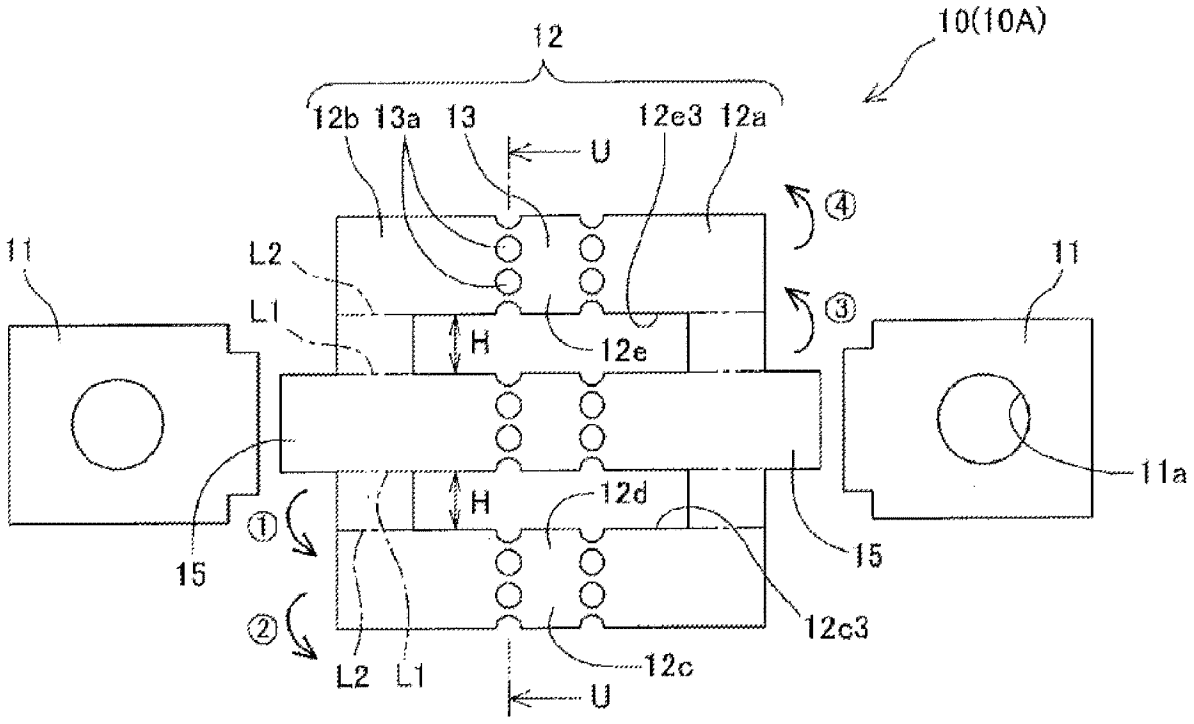
FIG. 2(*a*) is a development view of the terminal sections and element that have been subjected to stamping and thickness adjusting processes, which are intermediate steps of a process of fabricating the fuse element illustrated in FIG. 1, and FIG. 2(*b*) is an enlarged, lateral cross-sectional view of the bent fuse element illustrated in FIG. 2(*a*) as seen from the direction of the line U-U in FIG. 2(*a*).
Figure 2B:
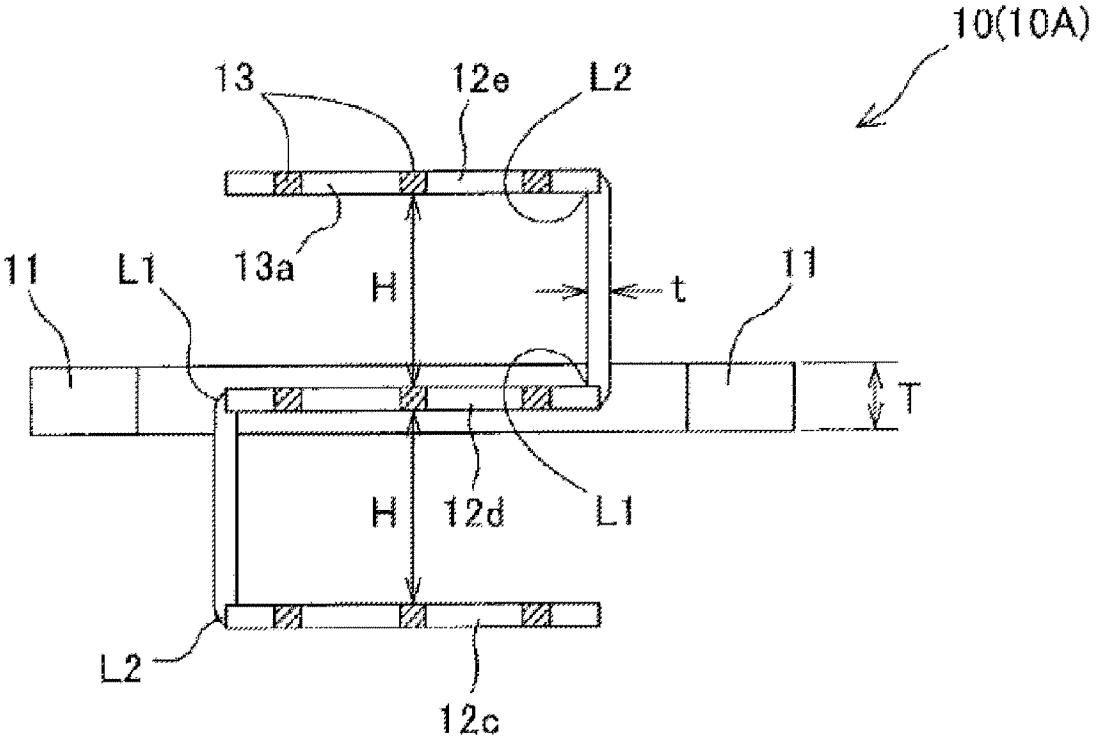

Referring to FIG. 1 again, the element 12 includes: base end sections 15 and 15 positioned at both ends; branch sections 12*a* and 12*b* separated from the respective base end sections 15 and 15; three rows of elements, that is, a lower element 12*c*, a central element 12*d*, and an upper element 12*e*, that connect the branch sections 12*a* and 12*b* while being arranged in parallel at spacings H (FIG. 2(*a*)). These three rows of elements 12*c*, 12*d*, and 12*e* have the same width, and a thickness t of the entire element 12 is set to smaller than a thickness T of the terminal section 11 (t<T).

Although the element 12 in this embodiment has three rows, it may have two or four or more rows in accordance with, for example, the application, type or rated current of the fuse element.

In this embodiment 1, the base end sections 15 and 15 positioned at both ends of the element 12 are soldered to the adjacent terminal sections 11 by soldered sections 14. With the soldering, the terminal sections 11 and 11 are integrally formed with the element 12.

However, a method of connecting the element 12 to both the terminal sections 11 and 11 may use any other means, such as screws, as described above.

In the fuse element 10 in this embodiment 1, all of the pair of terminal sections 11 and 11 and the element 12 connected thereto or the element 12 alone is formed by stamping a single metal plate to separate a piece having a preset shape therefrom and bending this piece into a predetermined three-dimensional shape.

Small circular holes 13*a* are formed, for example, in two rows (e.g., two small holes 13*a* are formed in each row) in the vicinity of each substantially central section 13 and in a direction perpendicular to a direction of the terminal sections 11 and 11. These circular holes 13*a* configure a fused section of a narrowed part having a smaller width in the direction perpendicular to that of the terminal sections 11 and 11. In the drawing, the fused section employs an exemplary small hole system, but may employ the system of another embodiment.

When a high current flows accidentally through the substantially central section 13 of the narrow part configured above, the current flow per unit of cross-sectional area increases, generating Joule heat or an arc. This heat can blow the substantially central section 13. To lower the melting point of a base material, or copper, of the narrow part, a metal having a low melting point, such as tin, silver, lead, nickel, or an alloy thereof, may be deposited on this narrowed part.

<Method of Fabricating Fuse Element 10 of the Present Invention>

A method of fabricating the fuse element 10 in FIG. 1 will be described in a process sequence, with reference to FIG. 2.

FIG. 2(*a*) is a development view of the terminal sections 11 and the element 12 that have been subjected to stamping and thickness adjusting processes, which are intermediate steps of a process of fabricating the fuse element 10 illustrated in FIG. 1. FIG. 2(*b*) is an enlarged, lateral cross-sectional view of the bent fuse element 10 illustrated in FIG. 2(*a*) as seen from the direction of the line U-U in FIG. 2(*a*).

1. Blank Layout Process of Element 12

Blanks, each of which is slightly larger in overall size than the entire element 12 in FIG. 2(*a*) are laid out within a copper plate (not illustrated) (or a copper alloy plate).

2. Stamping Process

The copper plate in which the blanks have been laid out is positioned by a device (not illustrated). Then, an automatic positioning and stamping machine (not illustrated), which has a die-cutter blade (not illustrated), such as a Thomson blade, the end of which has the same shape as the element 12 of FIG. 2(*a*), stamps the copper plate to separate a piece having the same shape as the element 12 of FIG. 2(*a*) therefrom. In this case, the piece having the same shape as the element 12 of FIG. 2 is preferably formed at a single stamping step. If there is any difficulty, however, a plurality of steps are performed sequentially. For example, the stamping process of the small hole 13*a* is performed as an independent step.

3. Bending Line Forming Process

Bending lines L1 and L2, which are marks indicating bending locations, are formed on each of the right branch section 12*a* and the left branch section 12*b*. It should be noted that this process is optional. The element 12 in FIG. 2(*a*) has been subjected to this process.

4. Bending Process

The right branch section 12*a* and left branch section 12*b* of the element 12 are sequentially bent at an angle of 90° along the bending lines L1 and L2 and in the direction of arrows 1 and 2 of the drawing; so that as illustrated in FIG. 2(*b*), the bent element 12 has a three-dimensional shape, and its lateral cross-section taken along the line U-U has a substantially inverted "S" shape.

More specifically, as illustrated in FIG. 2(*b*), first the branch sections 12*a* and 12*b* on both sides of the lower element 12*c* are sequentially bent twice at an angle of 90° along the bending lines L1 and L2 on the branch sections in the counterclockwise direction. As a result of these steps, the lower element 12*c* is formed in parallel to the central element 12*d* with a spacing H therebetween.

Next or simultaneously with the bending of the above lower element 12*c*, the branch sections 12*a* and 12*b* on both sides of the upper element 12*e* are sequentially bent twice at an angle of 90° along the bending lines L1 and L2 on the branch sections 12*a* and 12*b* in the counterclockwise direction. As a result of these steps, the upper element 12*e* is formed in parallel to the central element 12*d* with the spacing H therebetween.

5. Process of Soldering Element to Both Terminal Sections 11 and 11

The base end sections 15 and 15 of the element 12 are soldered to the terminal sections 11 and 11 that have been prepared separately.

Through the fabricating processes described above, the fuse element 10, in which the elements 12*c*, 12*d*, and 12*e* form a three-dimensional shape and substantially inverted "S" shaped lateral cross-section as illustrated in FIG. 2(*b*), has been fabricated. After that, necessary treatments are performed, including a process (not illustrated) of depositing a metal having a low melting point on the substantially central section 13, as described above, and an inspection.

<Effect of Present Invention>

Figure 11:
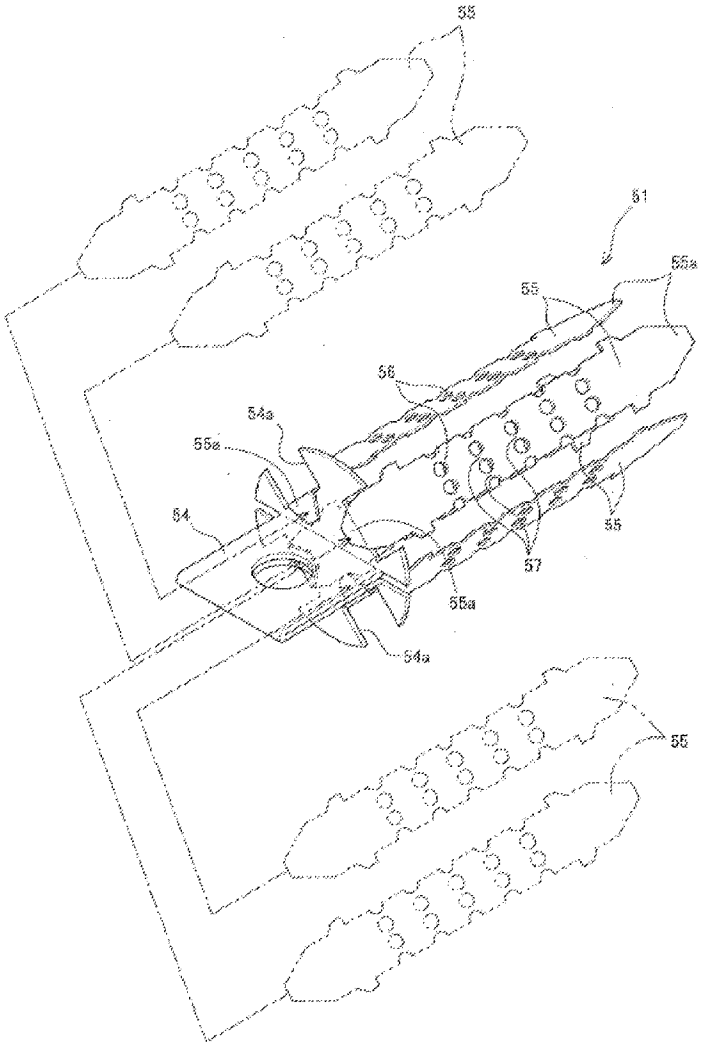
FIG. 11 is a perspective view used to explain a process of fabricating the fuse elements in the in-vehicle fuse illustrated in FIG. 10.

A fuse element 10 illustrated in FIG. 1 includes three parallel rows of elements 12 each of which has a substantially central section 13. These elements 12 are formed into a three-dimensional shape by stamping a single metal plate to separate a piece having a preset shape therefrom at one time and bending the piece into substantially inverted "S" shape. Therefore, the fuse element 10 completely obviates the need to individually prepare four elements 55 each of which has a fused section 57, unlike the elements 55 in the existing fuse element 51 having been described with reference to FIGS. 10 and 11. Furthermore, in soldering the elements to terminal sections 54, the fuse element 10 also completely obviates the need to perform a process of adjusting the locations of terminal sections 54 and the elements 55, which involves complicated work and a lot of skill.

In a fuse element 10 of the present invention, an element 12 including substantially central sections 13 is processed more accurately than both terminal sections 11 and 11. Therefore, mass-producing at least elements 12 using simple means successfully accomplishes the objects of the present invention.

In conclusion, a fuse element 10 in the first embodiment allows for simple fabricating processing, dramatically enhancing the productivity of fuse elements and fuses that contain them.

Three rows of elements 12*c*, 12*d*, and 12*e* each of which includes a substantially central section 13 are originally interconnected in parallel at one end by a branch section 12*a* and at the other end by a branch section 12*b*. This can provide a high-quality fuse element 10 with significantly high dimensional accuracy.

A fuse element 10 has a parallel circuit with substantially central sections 13 between a pair of terminal sections 11 and 11. This parallel circuit splits a fusing current flow into multiple flows, thus reducing arc energy.

<Modification of the Present Invention>

Figure 3:
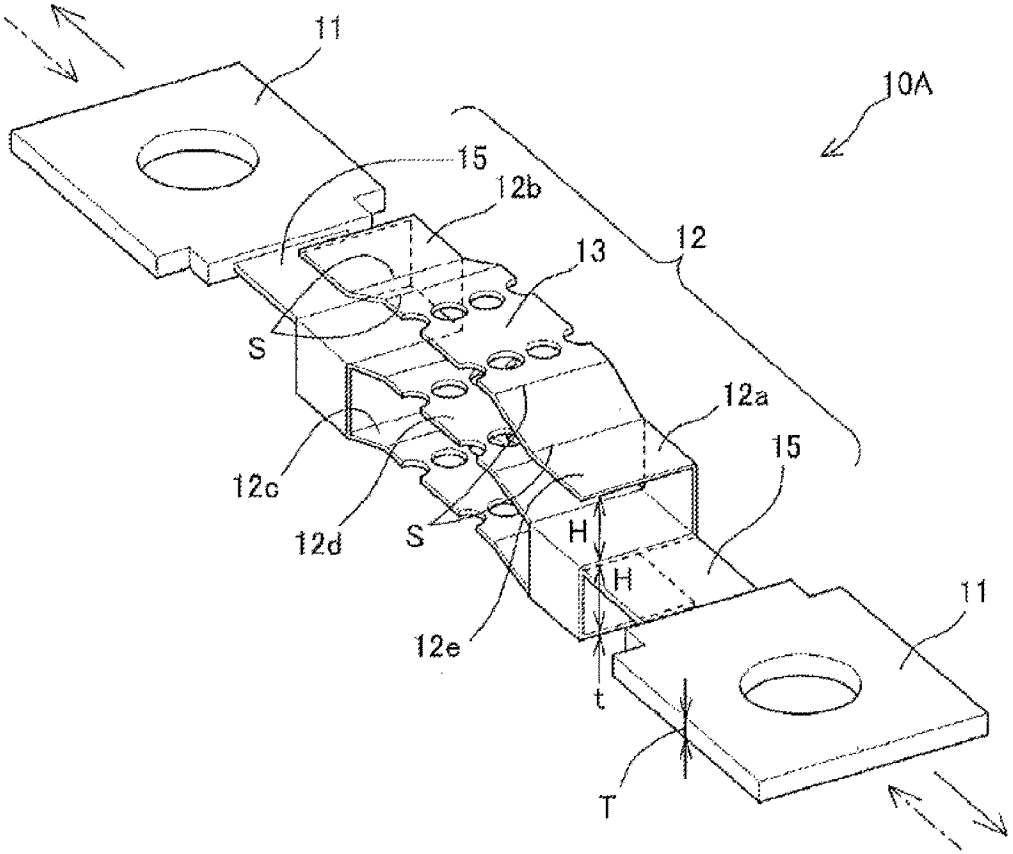
FIG. 3 is a perspective view of a first modification of the entire fuse element illustrated in FIG. 1.

FIG. 3 is a perspective view of an entire fuse element 10A, which is a first modification of the fuse element 10 illustrated in FIG. 1.

The fuse element 10A of this first modification differs from the fuse element 10 of FIG. 1 as follows. Terminal sections 11 and 11 and an element 12 are all formed by: stamping a single metal plate to separate, from this metal plate, a piece having a shape corresponding to the developed shape of the fuse element 10A of FIG. 3; and bending this piece into the three-dimensional shape illustrated in the drawing (second invention). Furthermore, three rows of elements 12*c*, 12*d*, and 12*e* constituting the element 12 are all bent and shrunk in the directions of the terminal sections 11 and 11 (arrow directions in the drawing), in order to accommodate the thermal expansion and contraction of the elements 12*c*, 12*d*, and 12*e* in these directions which would be caused due to an ambient temperature change during use (fourth invention).

In the drawing, bending lines S are formed as a result of a bending process.

In the fuse element 10A in an aspect of FIG. 3, the three rows of elements 12*c*, 12*d*, and 12*e* are bent while being arranged in parallel and at spacings H between the terminal sections 11 and 11 like the fuse element 10 of FIG. 1. Consequently, a parallel circuit with three rows of substantially central sections 13 is formed between terminal sections 11 and 11 (third invention).

In this embodiment, as described above, the three parallel rows of substantially central sections 13 are formed. However, four rows of substantially central sections 13 may be formed, like an embodiment 3 or 4 that will be described later, or five or more rows of substantially central sections 13 may be formed.

Next, a method of fabricating the fuse element 10A of FIG. 3 will be described with reference to FIGS. 2 and 3.

1. Blank Layout Process

Blanks, each of which is slightly larger in outer size than the developed shape of the entire fuse element 10A of FIG. 2(*a*) (i.e., all the terminal sections 11 and 11, the elements 12, 12 . . . ), are laid out within a copper plate (not illustrated) (or a copper alloy plate).

2. Thickness Adjusting Process of Element 12

The copper plate in which the blanks have been laid out in the preceding process is struck and flattened only at a site corresponding to the element 12 by a mechanical hammer (not illustrated). As a result, the thickness t of the element 12 is processed such that it becomes smaller than a thickness T of the terminal section 11 ($t<T$) (i.e., a kind of emboss process).

3. Stamping Process

The plate that has been subjected to the thickness adjustment is positioned in an automatic positioning and stamping machine (not illustrated). This stamping machine stamps the plate with a blade, the end of which has the same planar shape as the entire fuse element 10A of FIG. 2(*a*), thereby separating, from the plate, a piece corresponding to the developed shape of the fuse element 10A of FIG. 2(*a*) in which the base end sections 15 and 15 of the element 12 are connected to the terminal sections 11 and 11. In this case, the piece is preferably formed at a single step so that it has the same shape as the element 12 of FIG. 2(*a*) in which the base end sections 15 and 15 of the element 12 are connected to the terminal sections 11 and 11. If there is any difficulty, however, a plurality of steps may sequentially be performed.

4. Bending Line Forming Process

Bending lines L1 and L2 are optionally formed on the surfaces of a right branch section 12*a* and a left branch section 12*b*.

5. Bending Process

The right branch section 12*a* and the left branch section 12*b* are sequentially bent along the bending lines L1 and L2 in the directions of the arrows in the foregoing manner. Consequently, the element 12 is bent into a three-dimensional shape so that its lateral cross-section taken along a line U-U has a substantially inverted "S" shape, as illustrated in FIG. 2(*b*).

6. Element Bending and Shrinking Process

To accommodate the thermal expansion of the element 12 in the directions of the terminal sections 11 and 11 when a temperature changes, the lower element 12*c*, the central element 12*d*, and the upper element 12*e* are bent along the bending lines S (FIG. 3) as creases, and shrunk toward the substantially central section 13. If possible, this process may be performed simultaneously with the bending process described above.

The fuse element 10A, illustrated in FIG. 2, in this first modification is subjected to a stamping process while the terminal sections 11 are connected to the base end sections 15 and 15 of the element 12. Therefore, the fabricating process of the fuse element 10A is simpler than that of the fuse element 10 of FIG. 1, thus leading to dramatic enhancement of the productivity.

The elements 12*c*, 12*d*, and 12*e* are bent in the directions intersecting the directions of the terminal sections 11 and 11, and bent and shrunk in the directions of the terminal sections 11 and 11. Therefore, the elements 12*c*, 12*d*, and 12*e* can accommodate the thermal expansion and contraction in the directions of the terminal sections 11 and 11 when the ambient temperature changes during use. The accommodation of the thermal expansion (in the direction of the solid arrow in the drawing) and thermal contraction (in the direction of the alternate long and short dash arrow in the drawing) enables the fuse element 10A to have a longer lifetime.

Figure 4A:
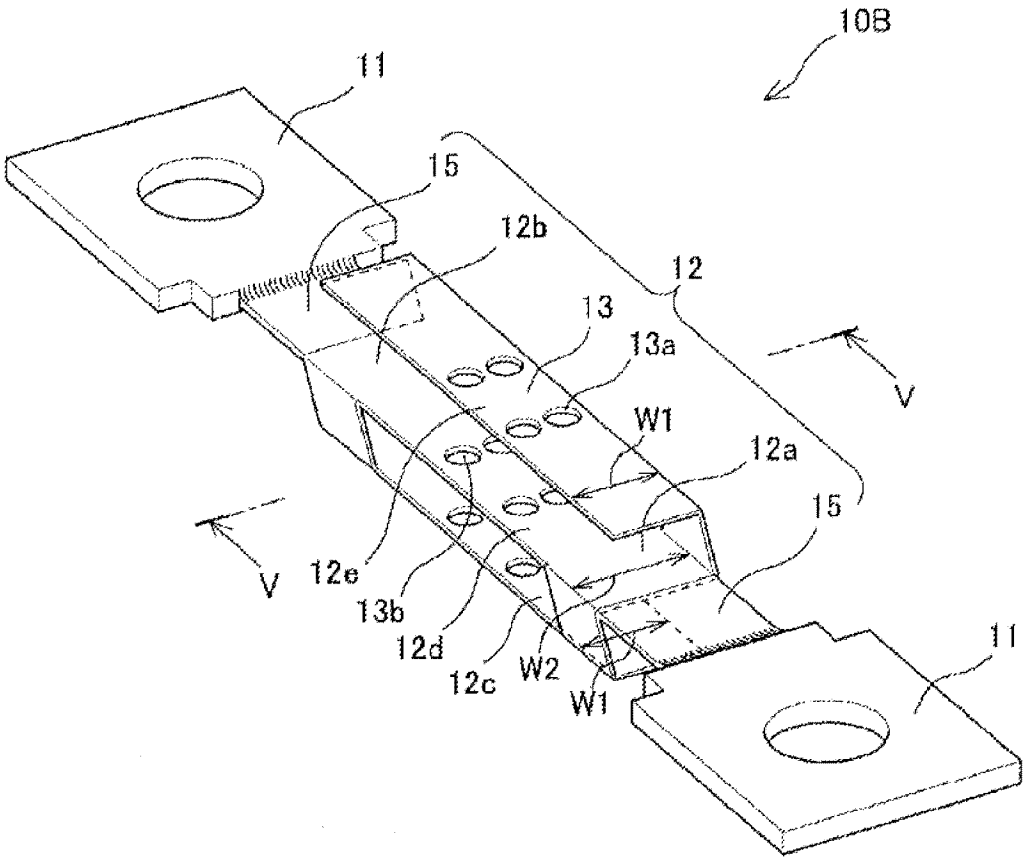
FIG. 4 is an illustrative view of a second modification of the fuse element illustrated in FIG. 1.
Figure 4B:
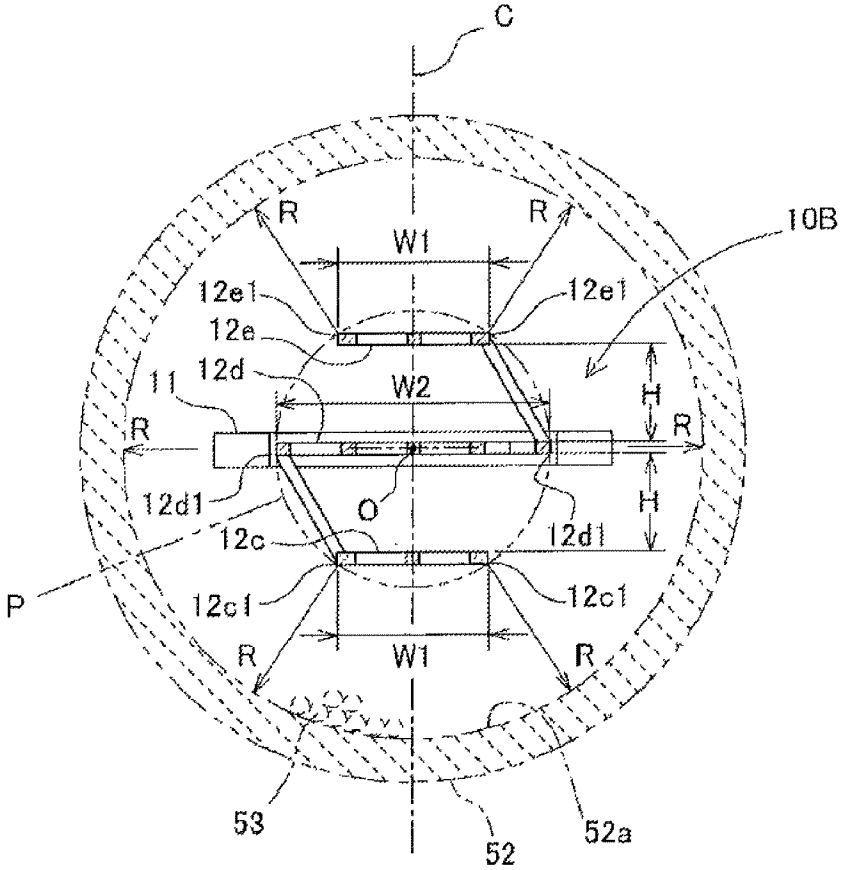

Next, FIG. 4 is an illustrative view of a fuse element 1 OB according to a second modification of the fuse element 10 illustrated in FIG. 1. More specifically, FIG. 4(*a*) is a perspective view of the entire fuse element 10B. FIG. 4(*b*) is an enlarged, lateral cross-sectional view of the fuse element 10B illustrated in FIG. 4(*a*) as seen from the direction of the line V-V passing through small holes 13*a* in substantially central sections 13.

Features of the second modification are as follows. As illustrated in the lateral cross-sectional view of FIG. 4(*b*), an element 12 is bent so that the lateral cross-sections of the substantially central sections 13 form a substantially inverted "S" shape. In addition, an upper sheet-shaped element 12*c* and a lower sheet-shaped element 12*e* are formed such that their width W1 is smaller than a width W2 of a central sheet-shaped element 12*d* (W1<W2). Further, respective distances (shortest distances) R, R, R, R, R, and R between a casing inner wall surface 52*a* and total six fused sections are identical to one another. The total six fused sections are: both ends 12*c*1 and 12*c*1, along the width, of the substantially central section 13 in the lower element 12*c*; both ends 12*e*1 and 12*e*1, along the width, of the substantially central section 13 in the upper element 12*e*; and both ends 12*d*1 and 12*d*1 of the substantially central section 13 in the central element 12*d*.

To satisfy a condition for the above configuration, it is necessary to arrange the three elements 12*c*, 12*d*, and 12*e* at regular spacings H and to position the lower element 12*c* and the upper element 12*e* symmetry with respect to a center line C.

Consequently, total six points, which are: both ends 12*c*1 and 12*c*1 of the substantially central section 13 in the lower element 12*c*; both ends 12*d*1 and 12*d*1 of the substantially central section 13 in the central element 12*d*; and both ends 12*e*1 and 12*e*1 of the substantially central section 13 in the upper element 12*e*, are all positioned on the circumference of a circle P that shares a center point O with a casing 52.

According to the fuse element 10B of the second modification, the respective distances R, R, R, R, R, and R between the casing inner wall surface 52*a* and both ends 12*c*1 and 12*c*1 of the substantially central section 13 in the element 12*c*, both ends 12*d*1 and 12*d*1 of the substantially central section 13 in the element 12*d*, and both ends 12*e*1 and 12*e*1 of the substantially central section 13 in the element 12*e* are all identical to one another. This allows the fuse element 10B to be contained within the casing 52 easily, and equally disperses a thermal influence that the substantially central sections 13, 13, and 13 of the elements 12*c*, 12*d*, and 12*e* exert upon the casing inner wall surface 52*a* when applying current and fusing.

Therefore, the casing inner wall surface 52*a* is less subject to sustain the thermal damage from the substantially central sections 13, 13, and 13, which are fused sections of the elements 12*c*, 12*d*, and 12*e*. This is effective in prolonging the lifetime of an entire fuse element.

Figure 5A:
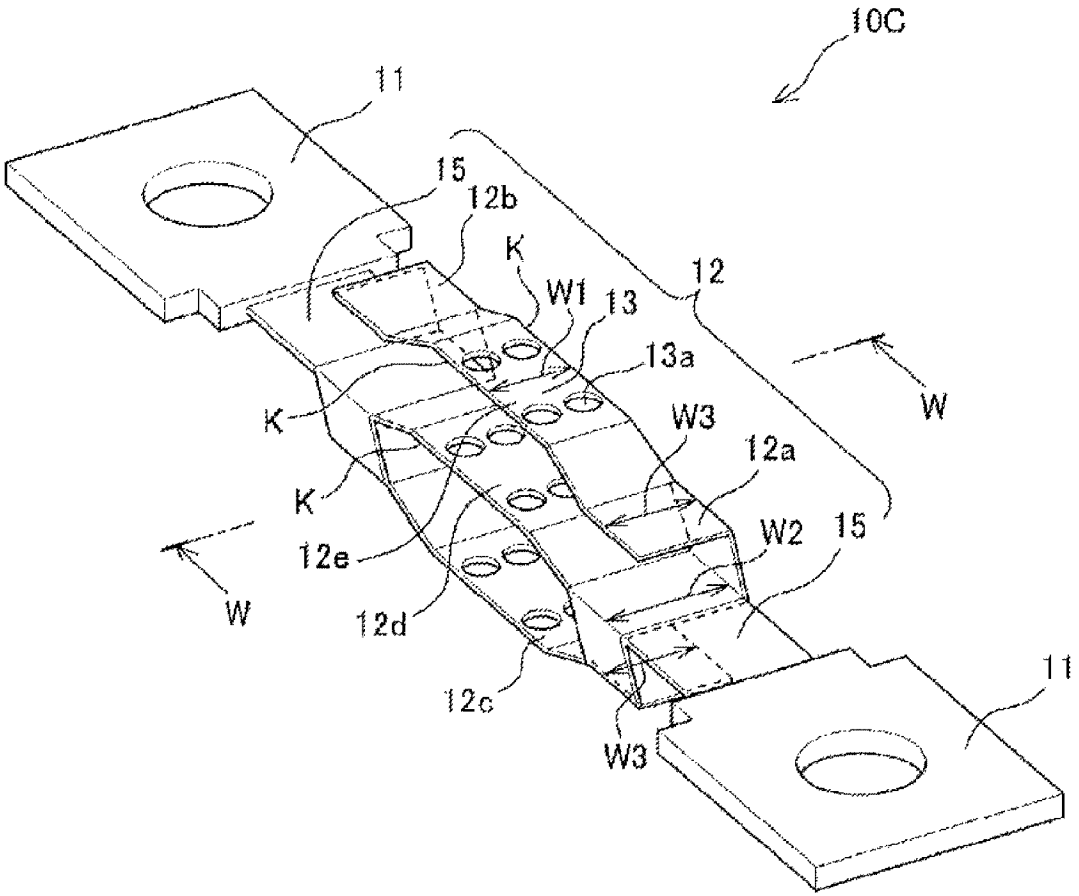
FIG. 5 is an illustrative view of a third modification of the fuse element illustrated in FIG. 1.
Figure 5B:
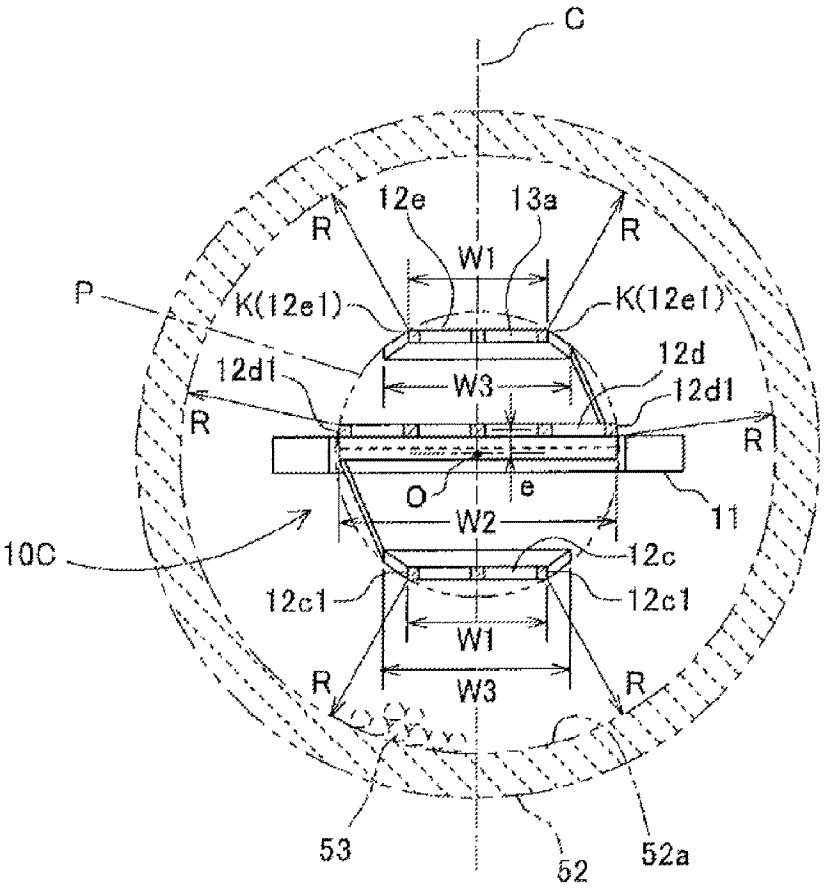
Figure 6B:
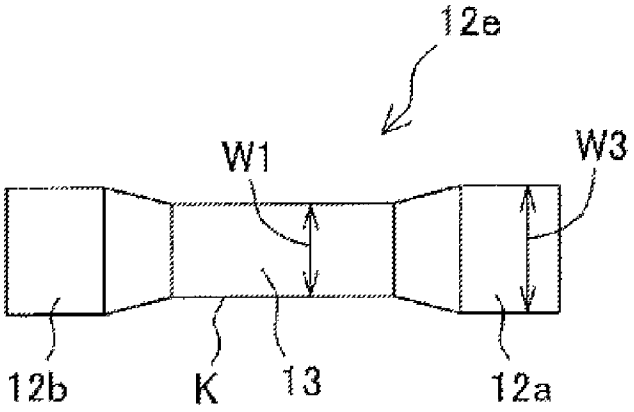
FIG. 6(*a*) is a side view of the narrowed part K illustrated in FIG. 5(*a*), FIG. 6(*b*) is a plan view of the narrowed part K, FIG. 6(*c*) is a side view of another example of the narrowed part K, and FIG. 6(*d*) is a plan view of the example of the narrowed part K.
Figure 6A:
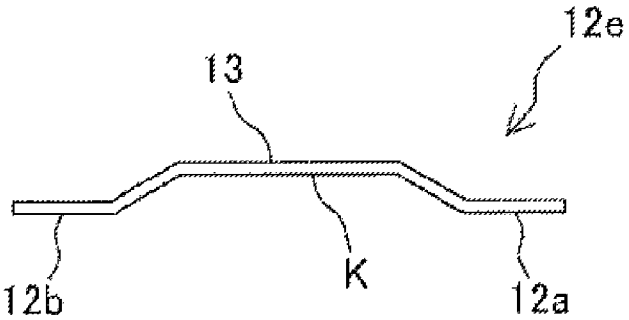
Figure 6D:
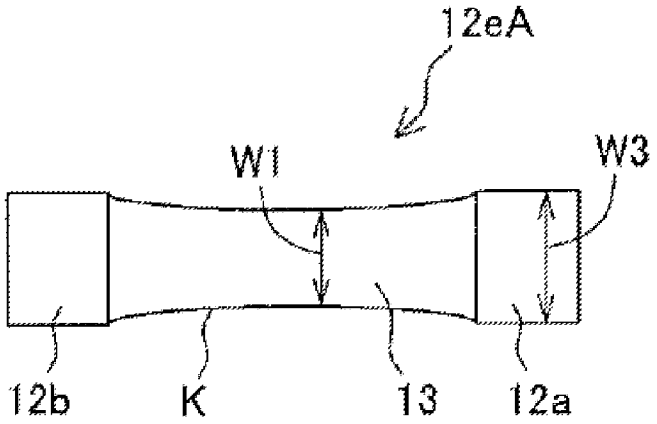
Figure 6C:
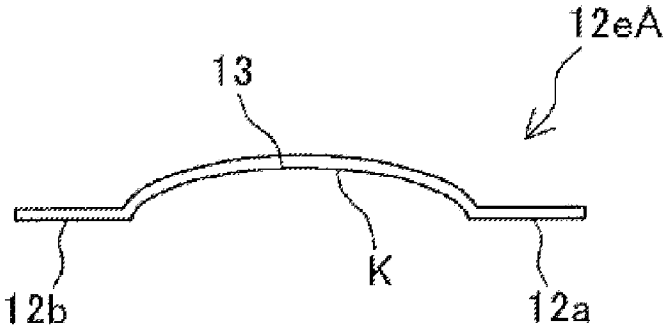

Next, FIG. 5 is an illustrative view of a fuse element 10C according to a third modification of the fuse element 10 illustrated in FIG. 1. More specifically, FIG. 5(*a*) is a perspective view of the entire fuse element 10C. FIG. 5(*b*) is an enlarged, lateral cross-sectional view of the fuse element 10C illustrated in FIG. 5(*a*) as seen from the direction of the line W-W passing through small holes 13*a* in substantially central sections 13.

As illustrated in FIG. 5(*a*), the fuse element 10C according to the third modification differs from the above fuse element 10B according to the second modification illustrated in FIG. 4(*a*), in that all constituent elements 12*c*, 12*d*, and 12*e* are bent and shrunk in the directions of terminal sections 11 and 11. Consequently, as illustrated in FIG. 5(*b*), the bending and shrinking causes the element 12 to be displaced upward from a center point O of a casing 52 by a displacement distance e.

In the above case, both ends 12*e*1 and 12*e*1 of the substantially central section 13 in the upper element 12*e* and both ends 12*d*1 and 12*d*1 of the substantially central section 13 in the central element 12*d* may protrude from the circumference of a circle P and be positioned closer to a casing inner wall surface 52*a*. This makes the casing inner wall surface 52*a* more subject to sustain a thermal damage from these ends.

To avoid the above disadvantage, the third modification equips both ends 12*e*1 and 12*e*1 of the substantially central section 13 in the upper element 12*e* and both ends 12*d*1 and 12*d*1 of the substantially central section 13 in the central element 12*d* with narrowed parts (notched parts) K. By cutting and removing the projecting parts and slightly pushing the lower element 12*c* in a downward direction of the drawing, both ends 12*c*1 and 12*c*1 of the substantially central section 13 in the element 12*c*, both ends 12*d*1 and 12*d*1 of the substantially central section 13 in the element 12*d*, and both ends 12*e*1 and 12*e*1 of the substantially central section 13 in the element 12*e* are all positioned on the circumference of a circle P centered at a center point O of the casing 52. As illustrated in the side view of FIG. 6(*a*) and the plan view of FIG. 6(*b*), each narrowed part K of the third modification has parallel straight sides, and a width W1 of the substantially central section 13 in the upper element 12*e* is smaller than a width W3 of the branch sections 12*a* and 12*b*. Alternatively, as illustrated in the side view of FIG. 6(*c*) and the plan view of FIG. 6(*d*), each narrowed part K may have incurved sides. The above structures may also be applicable to the lower central element 12*c* and central element 12*d*.

The distance between the element end and the case inner wall surface can be adjusted depending on whether the bent and shrunk form in the directions of the terminal sections is simply bent or curved. In accordance with this, the shape of the narrowed part K at the center of each element is also changed.

The above treatment enables the respective distances between the casing inner wall surface 52*a* and the ends 12*c*1 to 12e1 of the substantially central sections 13, 13, and 13 in all the elements 12c, 12d, and 12e to be equally set to a distance R as described above. This eliminates a risk that the casing inner wall surface 52a locally thermally damaged.

Therefore, in addition to the effect of the fuse element 10B according to the second modification described above, the fuse element 10C according to the third modification produces an effect of accommodating both the thermal expansion and contraction of the element 12 in the directions of the terminal sections 11 and 11 which would be caused due to an ambient temperature change.

In this embodiment 1, as illustrated in FIG. 5(a), all the element 12c, 12d, and 12e constituting the fuse element 10C are bent and shrunk in the directions of the terminal sections 11 and 11. Alternatively, one or more of the plurality of elements which would sustain a great thermal influence may be selected as targets, in consideration of, for example, the attitude of the arrangement in the fuse element 10C or a direction in which an arc is generated upon a fuse blowout. Then, only the target elements may be bent and shrunk in the directions along the terminal sections 11 and 11.

All of the fuse elements 10 to 10C of the present invention that have been described with reference to FIGS. 1 to 5 have a three-dimensional shape, and their lateral cross-sections have a substantially inverted "S" shape.

However, a fuse element of the present invention, however, can be bent into a three-dimensional shape so that its lateral cross-section has, any given shape other than a substantially inverted "S" shape.

Next, specific examples of the above will be described on the basis of FIGS. 7 to 9.

Example 2

Figure 7A:
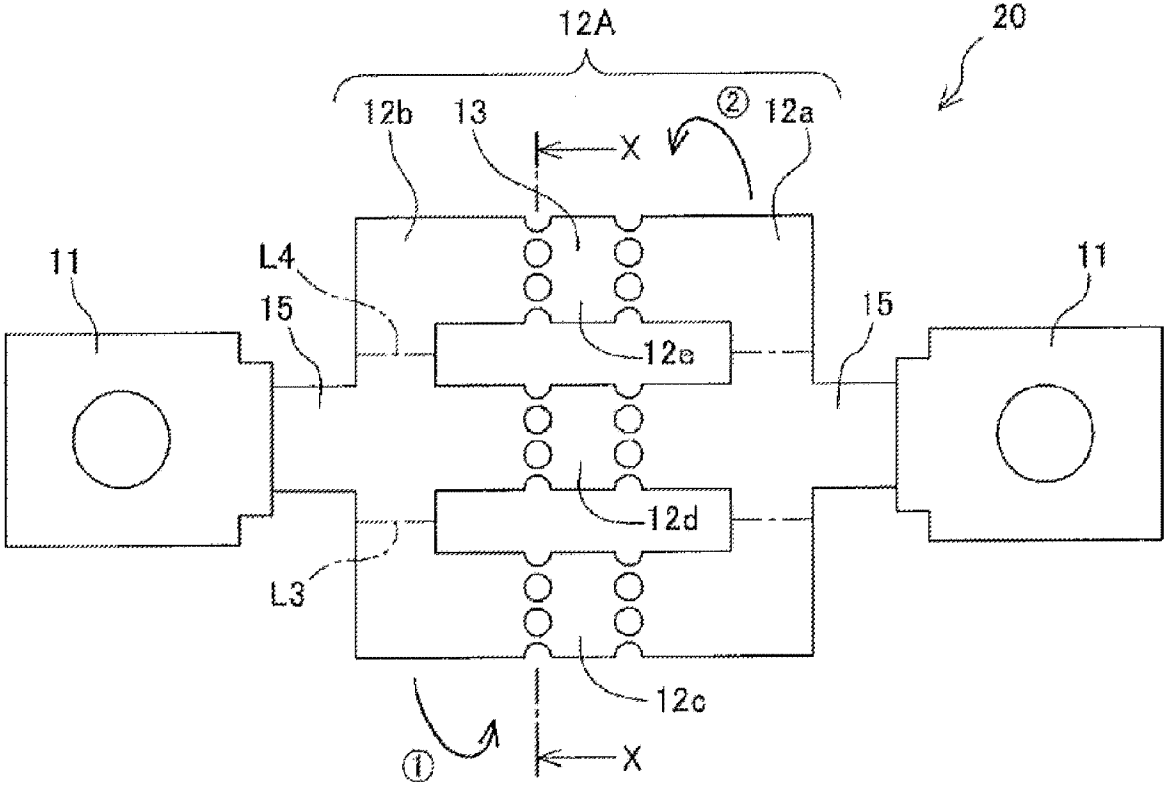
FIG. 7(*a*) is a development view of a fuse element according to a second embodiment of the present invention which has been subjected to a stamping process, which is performed during a process of fabricating the fuse element, and FIG. 7(*b*) is an enlarged, lateral cross-sectional view of the bent fuse element illustrated in FIG. 7(*a*) as seen from the direction of the line X-X in FIG. 7(*a*).
Figure 7B:
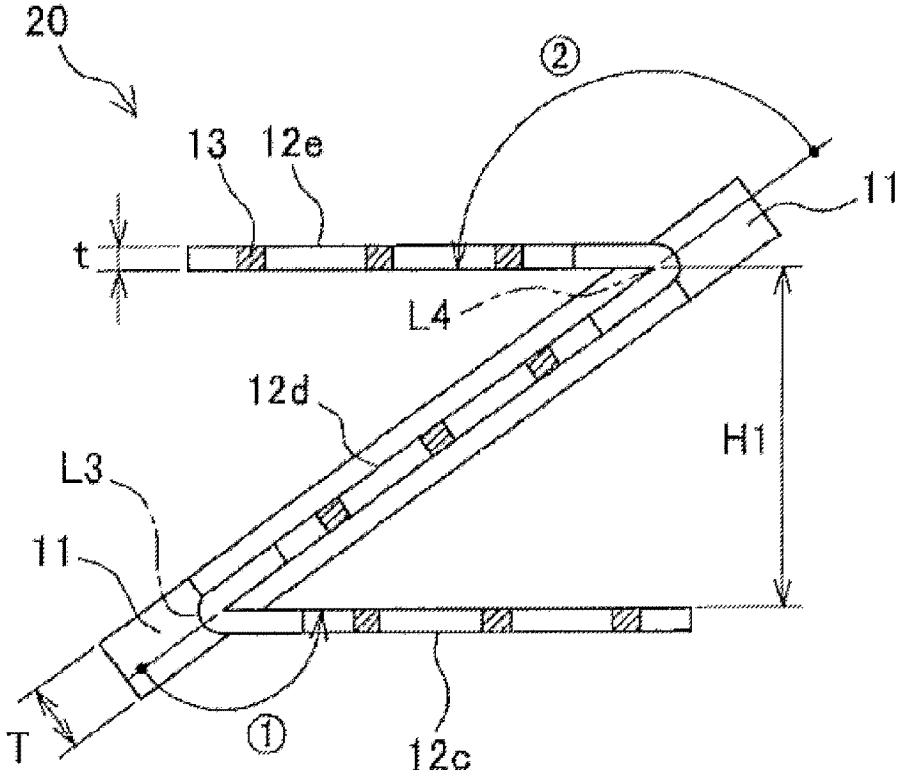

As illustrated in FIG. 7(b), a fuse element 20 in an embodiment 2 is bent into a three-dimensional shape so that the lateral cross-section of an element 12A has a substantially "Z" shape.

As described with reference to FIG. 2(a), in the fuse element 10 (10A) of the embodiment 1 in FIGS. 1 and 2, the bending lines L1 and L2 are formed on the extensions of inner side outer side surfaces 12c3 and 12e3 of each of the lower element 12c and the upper element 12e in the right branch section 12a and the left branch section 12b.

As illustrated in FIG. 7(a), however, the lateral cross-section of a substantially "Z" shape in the embodiment 2 differs from that in the embodiment 1, in that a bending line L3 of the fuse element 20 is formed on an extension of a middle portion of a lower element 12c and a central element 12d in the right branch section 12a and the left branch section 12b, and a bending line L4 of the fuse element 20 is formed on an extension of a middle portion of the central element 12d and an upper element 12e in the right branch section 12a and the left branch section 12b.

As illustrated in FIG. 7(b), the fuse element 20 can be formed by bending the lower element 12c at an angle of 135° along the bending line L3 in the counterclockwise direction from the central element 12d (the direction of arrow 1) and bending the upper element 12e at an angle of 135° along the bending line L4 in the counterclockwise direction from the central element 12d (the direction of arrow 2). In the embodiment 2, the lower element 12c and the upper element 12e are arranged "in parallel" at a predetermined spacing H1, but the surfaces of the central element 12d are not parallel to the two elements and inclined at an angle of 45°. Thus, the parallel rows of elements 12c, 12d, and 12e, which are defined in the present first invention, are arranged.

A fuse element 20 that includes an element 12A having a lateral cross-section of a substantially "Z" shape is provided with three rows of elements 12A, which are as many as those in the embodiment 1. The fuse element 20 is, however, effective because it can be contained within a casing (not illustrated) in more compact form.

Example 3

Figure 8A:
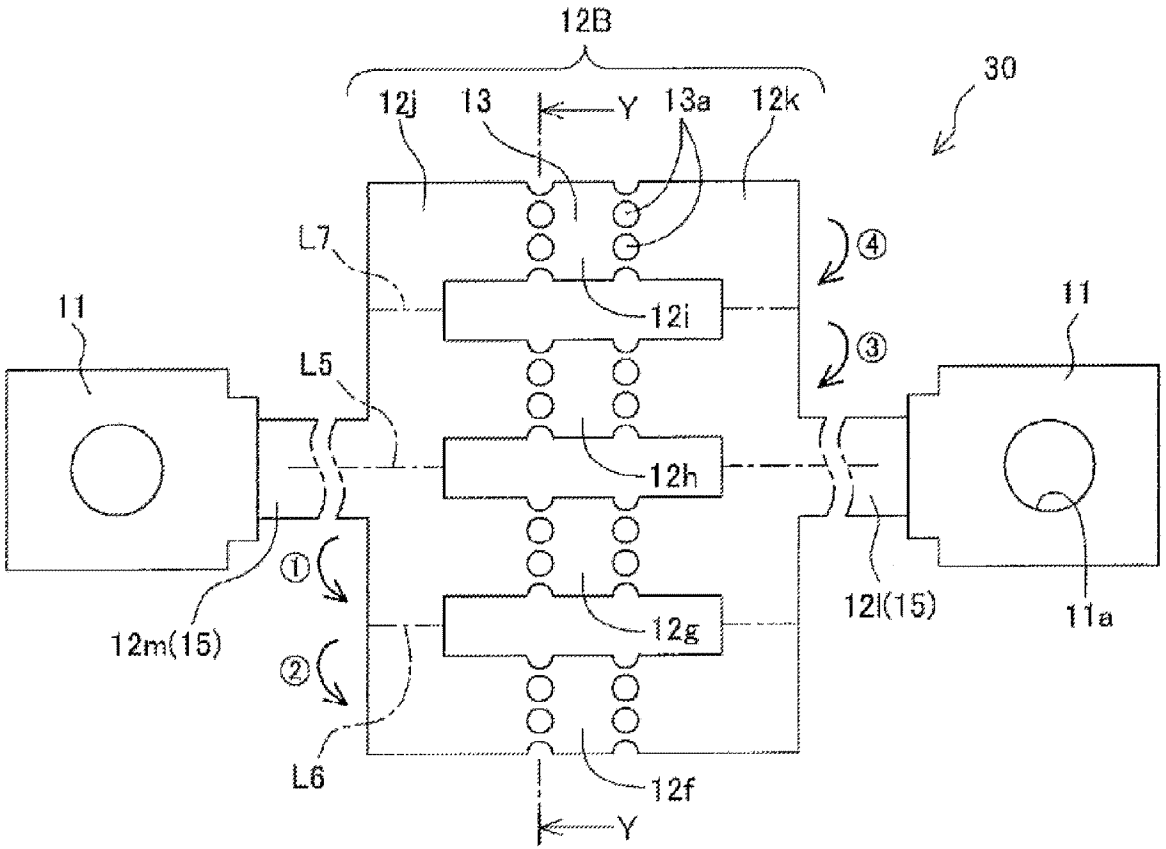
FIG. 8(*a*) is a development view of a fuse element according to a third embodiment of the present invention which has been subjected to a stamping process, and FIG. 8(*b*) is an enlarged, lateral cross-sectional view of the bent fuse element illustrated in FIG. 8(*a*) as seen from the direction of the line Y-Y in FIG. 8(*a*).
Figure 8B:
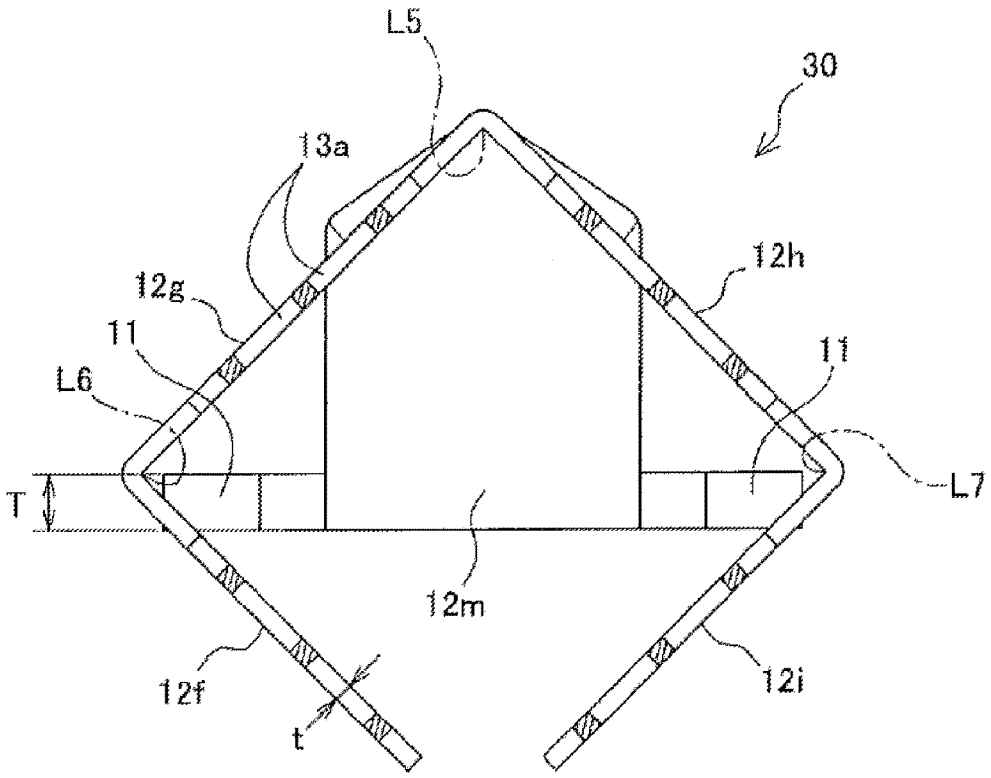

Next, as illustrated in FIG. 8(b), a fuse element 30 in an embodiment 3 is bent into a three-dimensional shape so that the lateral cross-section of its element has a "square" shape.

As illustrated in FIG. 8(a), the three-dimensional and substantially "square" shape can be created easily by bending element 12B in a right branch section 12k and a left branch section 12j along bending lines L5, L6, and L7, which are similar to the bending lines L3 and L4 of the fuse element 20 in the embodiment 2 which have been described with reference to FIG. 7(a). Further, the bending line L5 is a center line between elements 12h and 12g. The bending line L6 is a center line between the elements 12g and an element 12f. The bending line L7 is a center line between the element 12h and an element 12i.

More specifically, first, the element 12B is bent at an angle of 90° along the bending line L5 extending at the center of each of the right branch section 12k and the left branch section 12j. Then, the element 12B is sequentially bent at an angle of 90° along the bending lines L6 and L7 in inward directions of the arrows 1 to 4 in the drawing. This bending sequence enables the bent element 12B to be formed easily.

The fuse element 30 in the embodiment 3 can be contained appropriately within a casing (not illustrated) having a square lateral cross-section.

Example 4

Figure 9A:
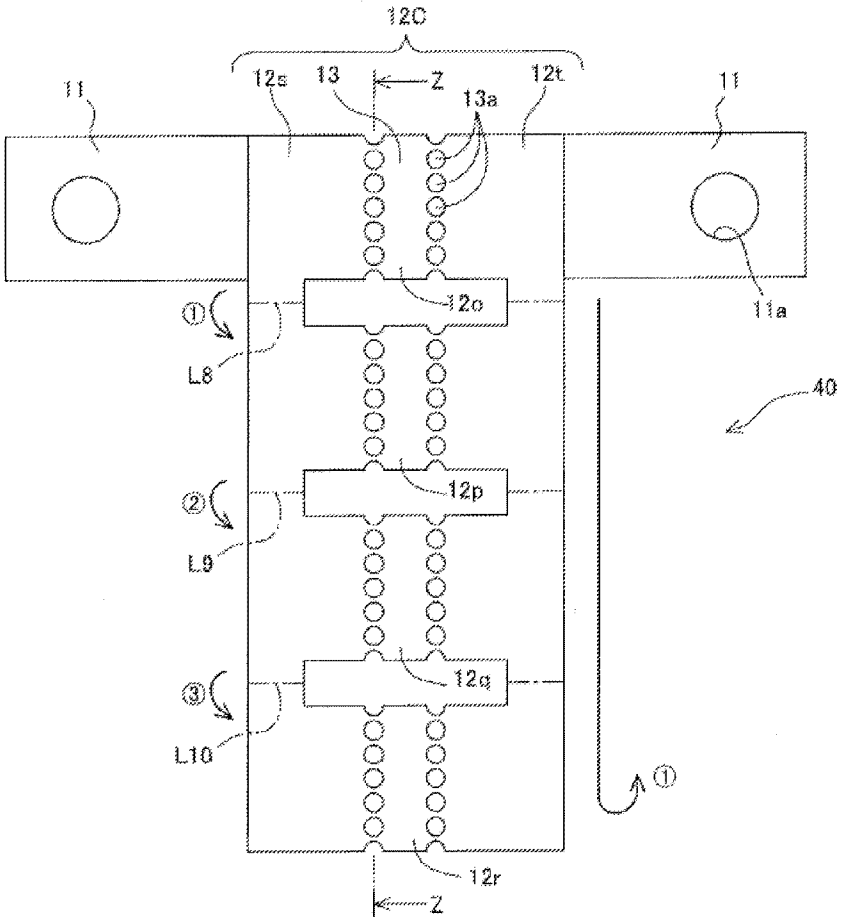
FIG. 9(*a*) is a development view of a fuse element according to a fourth embodiment of the present invention which has been subjected to a stamping process, FIG. 9(*b*) is an enlarged, lateral cross-sectional view of the bent fuse element illustrated in FIG. 9(*a*) as seen from the direction of the line Z-Z in FIG. 9(*a*), and FIG. 9(*c*) is an enlarged lateral cross-sectional view of another example of the bent fuse element illustrated in FIG. 9(*b*).
Figure 9C:
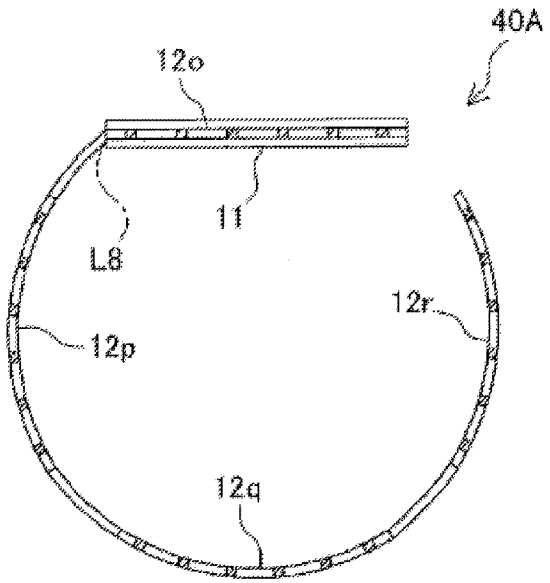
Figure 9B:
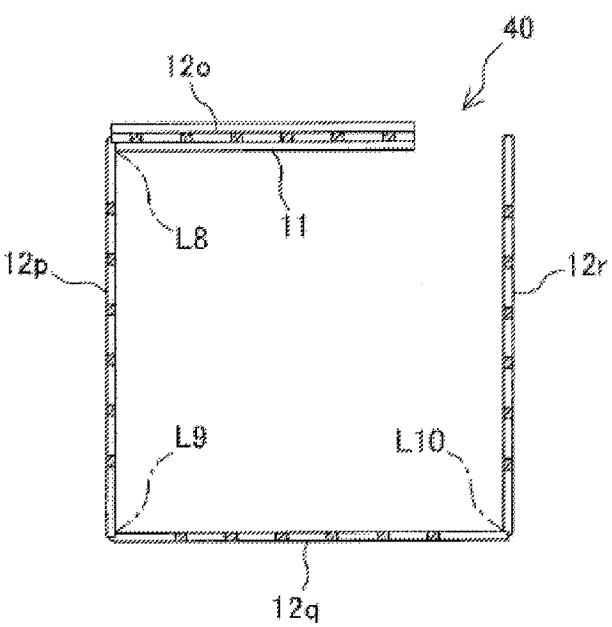

Next, as illustrated in FIG. 9(b), a fuse element 40 is formed by bending an element 12C illustrated in the development view of FIG. 9(a) into a three-dimensional shape so that its lateral cross-section has a "square" shape. As illustrated in FIG. 9(c), a fuse element 40A is formed by bending the element 12C illustrated in the development view of FIG. 9(a) into a three-dimensional shape so that its lateral cross-section has a "substantially circular" shape.

In the development view of each of the fuse elements 10 and 20 in the embodiments 1 and 2, respectively, the terminal sections 11 are positioned at the longitudinal center of the branch sections 12a and 12b. Likewise, in the development view of the fuse element 30 in the embodiment 3, the terminal sections 11 are positioned at the longitudinal center of the branch sections 12j and 12k. However, unlike the fuse element 20 in the embodiment 2 in which the terminal sections 11 are positioned at the center of the element 12A as illustrated FIG. 7(a), each of the fuse elements 40 and 40A in the embodiment 4 has terminal sections 11 positioned at the uppermost location of branch sections 12s and 12t.

In the fuse element 40 having a square lateral cross-section illustrated in FIG. 9(b), a bending line L8 is formed on a center line between elements 12o and 12p in both branch sections, a bending line L9 is formed on a center line between the element 12p and an element 12q in both branch sections, and a bending line L10 is formed on a center line between the element 12q and an element 12r in both branch sections, similar to the embodiments 2 and 3 described above. This fuse element 40 can be formed easily by bending the element 12C at an angle of 90° in the counterclockwise direction in order from arrow 1 to arrow 3.

The fuse element 40A having a substantially circular lateral cross-section illustrated in FIG. 9(*c*) can be formed easily by gradually bending the element 12C into a circular shape in the direction of arrow 1 in FIG. 9(*a*), or the counterclockwise direction.

The fuse elements 40 and 40A in the embodiment 4 can also be contained appropriately within casings having square and circular lateral cross-sections, respectively. The fuse element 40A having a substantially circular lateral cross-section illustrated in FIG. 9(*c*) is particularly effective in reducing Joule heat damage to the casing more greatly than any other embodiments, because the substantially central sections 13, 13 . . . are apart from a casing inner wall surface 52*a* (not illustrated) by an equal distance.

The fuse elements 10 to 40A in the embodiments 1 to 4 are simply exemplary and not intended to limit a fuse element of the present invention. Other modifications and combinations are possible without departing from the spirit of the invention and should be included within the scope of the invention.

Applications of a fuse element according to the present invention are not limited to in-vehicle fuses. This fuse element is applicable to different types of fuses, and obviously such fuses should also be included within the technical scope of the invention.

DESCRIPTION OF REFERENCE SIGNS

10, 10A, 10B, 10C, 20, 30, 40, 40A: Fuse element (present invention)
11: Terminal section
11*a*: Attachment hole
12 to 12C: Element
12*c*: Lower element
12*d*: Central element
12*e*: Upper element
13: Substantially central section
13*a*: Small hole
14: Soldered section
15: Base end section
H: Spacing
K: Narrowed part

The invention claimed is:

1. A fuse element comprising:

a pair of terminal sections positioned at opposite ends of the fuse element;

a plurality of spaced parallel rows of elements connecting the terminal sections via a pair of base end sections; and a plurality of fused sections formed in substantially central sections of the elements, wherein the terminal sections and the elements or the elements alone are formed from a single metal plate having a predetermined shape into a predetermined three-dimensional bent shape, and the plurality of elements are connected to each other only via the base end sections so that a parallel circuit with the fused sections is formed between the terminal sections by arranging the plurality of elements in parallel and at a predetermined spacing between the terminal sections, two bending lines and a flat surface extending in a direction of the terminal sections between the two bending lines are arranged at each of a plurality of connecting parts of the elements where the elements and the base end sections are connected, the elements are bent in a direction intersecting the direction of the terminal sections at the two bending lines respectively, and the elements are connected to the base end sections only by the flat surfaces extending in the direction of the terminal sections.

2. The fuse element according to claim 1, wherein the terminal sections and the plurality of elements are formed from a single metal plate having a predetermined shape into a predetermined three-dimensional bent shape.

3. The fuse element according to claim 1, wherein the elements are bent and shrunk in the direction of the terminal sections.

4. The fuse element according to claim 2, wherein the elements are bent and shrunk in the direction of the terminal sections.

5. The fuse element according to claim 1, wherein one of the elements is positioned away from a central element and has a smaller width than the central element, and the element positioned away from the central element is bent in a direction intersecting the direction of the terminal sections.

6. The fuse element according to claim 2, wherein one of the elements is positioned away from a central element and has a smaller width than the central element, and the element positioned away from the central element is bent in a direction intersecting the direction of the terminal sections.

* * * * *